United States Patent [19]

Chaumeau et al.

[11] Patent Number: 4,714,022

[45] Date of Patent: Dec. 22, 1987

[54] WARHEAD WITH TANDEM SHAPED CHARGES

[75] Inventors: Alain Chaumeau, Levet; Eric Crotet, Mehun sur Yevre; Alain Kerdraon; Jean-Paul Ragonnet, both of Bourges, all of France

[73] Assignee: Etat Francais, Paris, France

[21] Appl. No.: 772,463

[22] Filed: Sep. 4, 1985

[30] Foreign Application Priority Data

Sep. 5, 1984 [FR] France ..... 84 13633

[51] Int. Cl.[4] ..... F42B 3/08

[52] U.S. Cl. ..... 102/476; 102/308

[58] Field of Search ..... 102/475, 476, 306–310

[56] References Cited

U.S. PATENT DOCUMENTS 3,217,647 11/1965 Thomanek ..... 102/310
3,358,780 12/1967 Venghrattis ..... 102/308 X
3,750,582 8/1973 Kintish et al. ..... 102/476
4,004,515 1/1977 Mallory et al. ..... 102/308

*Primary Examiner*—Harold J. Tudor
*Attorney, Agent, or Firm*—Parkhurst & Oliff

[57] ABSTRACT

A warhead designed for employment against a target having active armor protection comprises a forward shaped charge and a rear shaped charge. The forward shaped charge generates a core explosion whose speed is below 2,500 meters per second, and thus does not detonate the active armor, while the rear charge is formed of a high-performance, high-explosive charge and completely pierces the armor. A time delay of between 50 and 300 μsec is employed for detonating the rear charge after the detonation of the first charge. This type of warhead is suitable for piercing rolled homogenous armor (RHA), or spaced, composite, or active armor, and can be fired by means of rockets, missiles, shells, etc.

9 Claims, 2 Drawing Figures

WARHEAD WITH TANDEM SHAPED CHARGES

BACKGROUND OF THE INVENTION

This invention relates to explosive devices, especially those of a military nature, and is more particularly directed to a warhead to be used in shells, rockets, and/or missiles. The improved warhead of this invention is favorably employed with weapons that can be used for attacking tanks or other armored vehicles whose armor may be rolled homogenous armor (RHA), spaced armor, composite armor, or active armor.

The advent of new types of armor, especially the so-called active armors, has spurred development of a new concept employing tandem-mounted shaped charge warheads, which employ two or more shaped explosive charges. Detonation of the first or forward charge brings about, sequentially, that of the second, but with a delay time ($\Delta T$) between the two.

The above delay is necessary, for one thing, to prevent the second charge from detonating until after the outer or active protection has been destroyed, this delay interval corresponding to the life of the active armor; the delay is also necessary to prevent the jet blast from the first charge explosion from being overtaken by the jet blast from that of the second charge. The optimum delay time $\Delta T$ varies according to both the nature and the thickness of the plates that comprise the active armor, and depends as well on the projectile's angle of incidence onto the target. Too long a delay time $\Delta T$ can lead to unfavorable consequences in operation. For example, excessive delay time $\Delta T$ can require an increase in the optimal or stand-off range of the second explosive charge and a reduction in the speed of the projectile, and can lead to an increase in the interaction between the two charges.

SUMMARY OF THE INVENTION

The object of this invention is thus to remedy the abovementioned drawbacks by proffering a warhead with tandem-mounted shaped charges which act sequentially so that the forward charge, disposed in the nose of the warhead, generates a core explosion capable of piercing the active armor without initiating the active protection; the second shaped charge, disposed in tandem behind the first charge, can then be detonated after a very brief delay, this delay being long enough to prevent the core explosion generated by the first charge from being overtaken by the jet blast from the second charge; however, this delay can be reduced to a minimum because the defensive action of the active armor is prevented or avoided.

The warhead of this invention thus has the improved features wherein the first or forward charge generates an explosive core whose target impact speed is in the range of about 1,000–2,500 meters per second, and the delay time $\Delta T$ in activation between the first and second charges is in the range of between about 50 and 300 $\mu$sec.

In a specific example, the forward charge generates an explosive core whose speed is on the order of 2,000 meters per second, and the delay in activation between the two charges is on the order of about 100 $\mu$sec.

In one particular embodiment, the forward charge has a concave conical metal liner whose apex angle is between 140 degrees and 170 degrees, and most favorably equals substantially 150 degrees. The average thickness of the casing or sheath is between about 1 percent and 2 percent, most favorably 1.6 percent, of the caliber (diameter) of the forward charge.

According to another embodiment, the forward charge has a concave rounded metal liner which can be, for example, spherical or ellipsoidal, and whose ratio of height (axial extent) to diameter or caliber is between 0.05 and 0.15, most favorably 0.1, and whose average thickness is between about 1 percent and 2 percent, and most favorably 1.8 percent, of the caliber or diameter of the forward charge. Other features of the warhead of this invention are that the detonation speed of the explosive used for the forward charge is below about 8,000 meters per second, and can be comprised, for example, of a composite explosive, trinitrotoluene, or baratol; as aforesaid, the delay in activation between the forward charge and the rear charge can be about 100 $\mu$sec.

The above and many other objects, features, and advantages of this invention will be more fully understood from a perusal of the following detailed description of a preferred embodiment of this invention, which is offered as an example, but without limitation to those variations which may present themselves to those skilled in the art.

DETAILED DESCRIPTION OF A PREFERRED EMBODIMENT

Figure 1:
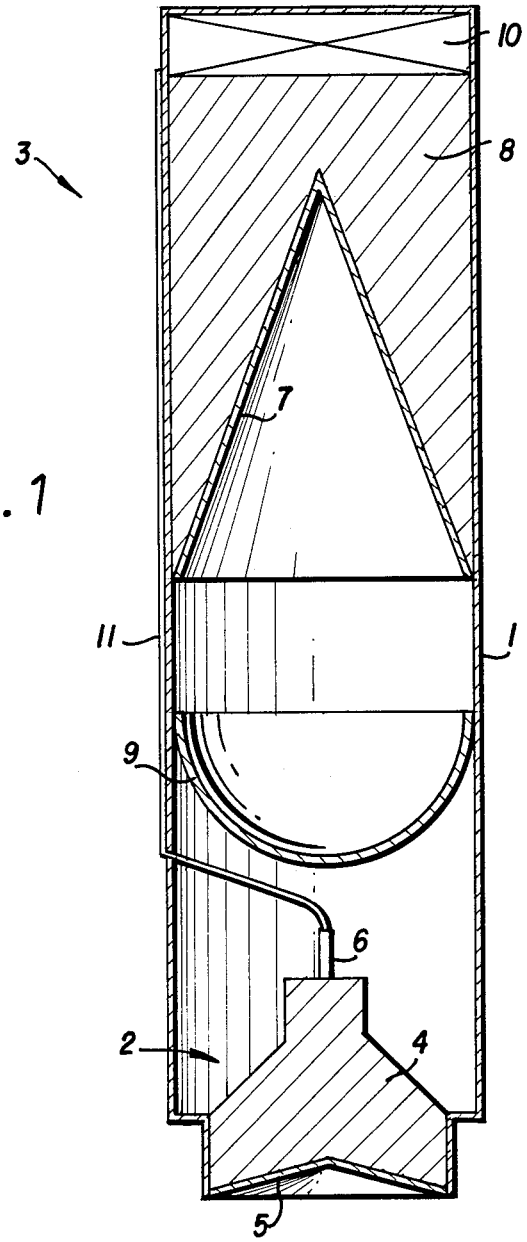
FIG. 1 is a longitudinal cross-section of one embodiment of the warhead of this invention.

With reference initially to FIG. 1, the warhead of the disclosed embodiment comprises a casing 1 in which are mounted, in tandem, two shaped explosive charges 2 and 3, hereinafter referred to as the forward charge and the rear charge, respectively.

The forward charge 2 includes a mass of explosive material 4 in front of which is a concave metal liner 5, and behind which is a priming mechanism 6. The latter is not shown in detail, but would be well known to specialists in this field.

Figure 2:
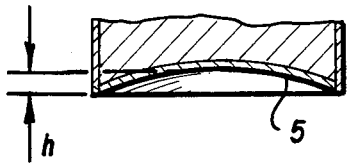
FIG. 2 is a cross-section of a portion of a variant of the embodiment of FIG. 1.

The liner 5 can be conical, as shown in FIG. 1, or can be spherical or ellipsoidal, or of other rounded shape, as shown in FIG. 2. The liner 5 can take on any geometric shape so long as its geometric characteristics generally satisfy the following conditions:

If the liner 5 is conical, its apex angle must be between 140 degrees and 170 degrees, and its average thickness must be between about 1 percent and 2 percent of the diameter (calliber) of the charge 2. In the particular case illustrated here, the apex angle is 150 degrees and the thickness equals 1.6 percent of the caliber of the charge.

If the liner 5 is rounded, as shown in FIG. 2, e.g. spherical or ellipsoidal, its axial height h, i.e. its extent in the axial direction from the dished-in center of the front of the charge 2 to the plane of the rim of the charge 2, should be such that the length-to-diameter ratio is between substantially 0.05 and 0.15, with the thickness considerations the same as those described above for the conical liner 5.

The explosive 4 used in the forward charge 2 must be of the low energy type, with a detonation speed of less than about 8,000 meters per second. Examples of suitable explosives are trinitrotoluene, baratol, and composite explosives.

The geometric characteristics of the liner 5, as well as the nature of the explosive 4 used for the forward charge 2, must be calculated in such a way that the target impact speed of the core explosion, when the forward charge 2 is detonated, is less than 2,500 meters per second. This condition is required to avoid initiation of the explosive that constitutes the active armor of the target.

The rear charge 3 is constituted here as a high-performance, high-explosive hollow shaped charge, and includes an acute-angle conical liner 7 and a mass of explosive material 8, which is favorably a high-energy explosive.

The warhead 1 also comprises a protective screen 9 whose function is to protect the rear charge 3 when the forward charge 2 detonates.

A safety and arming device 10 is disposed to the rear of the rearward charge 3 and transmits the initiation order to the forward charge 2 through a detonating fuse 11 connected to the priming mechanism 6 on the forward charge 2. The fuse 11 can be replaced with an electric line.

Target detection can be accomplished by any of various means known to specialists in the field, such as a proximity fuse or a contact fuse. Similarly, the delay in activation as between the forward charge 2 and the rear charge 3 can be achieved with a coiled length of detonating fuse, by an electrical delay device, or by a pyrotechnical explosive delay component. In this particular embodiment, a delay time of 100 $\mu$sec is used.

One particular advantage of this invention is that it makes it possible to pierce active armor with a lightweight warhead. This comes about because the protection 9 between the charges 2 and 3 can be scaled down, given the very short activation delay or initiation delay time $\Delta T$ needed between the two charges 2 and 3. Moreover, because the target's active armor protection is never initiated, the effectiveness of this type of warhead is not degraded by the characteristics of the active armor, such as the active armor plate projection speeds or the lateral dimensions of the active armor plates.

While the foregoing embodiments of this invention have been described in detail hereinabove, it should be recognized that the invention is not limited to the precise described embodiments, and that many modifications and variations thereof would be apparent to those of skill in the art without departure from the scope and spirit of this invention, as defined in the appended claims.

What we claim is:

1. An armor-defeating warhead of the type intended for attack against an active armored target, comprising a forward shaped charge, a rearward shaped charge, means for mounting said forward and rearward charges in tandem, and delay timing means for imparting an activation delay in the detonations of said charges from the forward to the rearward charge; wherein said forward charge is provided with a metallic liner having an average thickness substantially between 1 and 2 percent of the diameter of said forward charge, so as to generate, when detonated, an explosive core having a target impact speed of between substantially 1,000 and 2,500 meters per second for impacting said active armored target without detonation thereof, and wherein said delay timing means imparts an activation delay of between substantially 50 and 300 sec between initiation of the forward charge and subsequent initiation of the rearward charge.

2. A warhead according to claim 1, wherein the forward charge is so constructed as to generate its core with a target impact speed of substantially 2,000 meters per second, and wherein the delay timing means imparts said activation delay on the order of 100 $\mu$sec.

3. A warhead according to claim 1, wherein said liner is of a concave conical type having an apex angle of between substantially 140 degrees and 170 degrees.

4. A warhead according to claim 1, wherein said liner is made of an aluminum alloy.

5. A warhead according to claim 3, wherein said apex angle of said liner is substantially equal to 150 degrees, and wherein said average thickness is substantially equal to 1.6 percent of the diameter of said forward charge.

6. A warhead according to claim 1, wherein said liner is of a concave rounded type, the ratio of the height of said liner to said diameter being between substantially 0.05 and 0.15.

7. A warhead according to claim 6, wherein said liner is spherical.

8. A warhead according to claim 6, wherein said liner is ellipsoidal.

9. A warhead according to claim 1, wherein said forward charge is provided with an explosive material selected from the group consisting of trinitrotoluene, baratol and composites thereof.

* * * * *